US006138303A

United States Patent [19]

Alvestad

[11] Patent Number: 6,138,303

[45] Date of Patent: Oct. 31, 2000

[54] ADJUSTABLE PIECE OF FURNITURE

[76] Inventor: Kjartan Alvestad, N-6222, Ikornnes, Norway

[21] Appl. No.: 09/155,984

[22] PCT Filed: Apr. 11, 1997

[86] PCT No.: PCT/NO97/00095

§ 371 Date: Dec. 15, 1998

§ 102(e) Date: Dec. 15, 1998

[87] PCT Pub. No.: WO97/37567

PCT Pub. Date: Oct. 16, 1997

[30] Foreign Application Priority Data

Apr. 11, 1996 [NO] Norway ..... 961441

[51] Int. Cl.[7] ..... A47B 7/02

[52] U.S. Cl. ..... 5/618; 5/613

[58] Field of Search ..... 5/613, 617, 618

[56] References Cited

U.S. PATENT DOCUMENTS

| | | | |
|---|---|---|---|
| 3,665,528 | 5/1972 | Kjellberg et al. | 5/618 |
| 4,371,996 | 2/1983 | Nahum . | |
| 4,403,357 | 9/1983 | Degen . | |
| 4,751,754 | 6/1988 | Bailey et al. . | |
| 4,996,731 | 3/1991 | Kruyt | 5/618 |
| 5,160,010 | 11/1992 | Peterson | 5/613 |

FOREIGN PATENT DOCUMENTS

| | | |
|---|---|---|
| 332 586 | 10/1976 | Austria . |
| 125771 | 5/1973 | Denmark . |
| 145563 | 12/1982 | Denmark . |
| 89867 | 8/1993 | Finland . |
| 149513 | 8/1901 | Germany . |
| 23 09 305 | 9/1974 | Germany . |
| 3401 701 | 8/1984 | Germany . |

*Primary Examiner*—Terry Lee Melius
*Assistant Examiner*—James M Hewitt
*Attorney, Agent, or Firm*—Finnegan, Henderson, Farabow, Garrett & Duner, L.L.P.

[57] ABSTRACT

A system for adjustment of the angular setting between parts in a bed or another reclining or sitting article of furniture, in which the article has two or more mutually adjustable, articulated parts, and where the frame is mounted in a support member by means of transverse axles or axis journals. A pivot axis (2) of a back member is fixed against translation in a pivot bearing (11) on the support member. The axes (3, 5) of the remaining part(s) are movably mounted in the longitudinal direction of the support member. The back member axis (2) is mounted at a distance from the joint connection (1) of the seat member (S).

8 Claims, 6 Drawing Sheets

ADJUSTABLE PIECE OF FURNITURE

BACKGROUND OF THE INVENTION

1. Field of the Invention

The invention relates to adjustable beds and other reclining or sitting articles of furniture in which a supporting member carries an articulated frame including two or more mutually adjustable parts, such as a back member, a seat member and optionally a foot member. More particularly, the frame is mounted in the support member by horizontal, transverse axles which provide pivot points for the mutually adjustable parts.

2. Description of the Related Art

There are a number of different kinds of beds and other reclining and sitting articles of furniture currently on the market and equipped with adjustment devices for setting different angles between the back member, the seat member and the foot member in order to provide the article with alternative user positions. The most common examples are adjustable chairs, where the back member and seat member can be set at an angle in relation to each other in order to provide a position of rest or a more active sitting position. Similar solutions have been developed for beds, offering the possibility of assuming a position which is more suitable for reading in bed, etc.

Such adjustable beds and chairs are employed not only for reasons of comfort, but are particularly important in nursing and illness situations, such as in hospital or in nursing institutions where the user has to stay for lengthy periods, e.g. in a bed, or in connection with therapeutic chairs for dentists, doctors, etc.

Examples of adjustable beds and other reclining or sitting furniture can be found in U.S. Pat. No. 4,751,754 and in Finnish Patent No. 89867, both of which disclose adjustable hospital beds, as well as in Danish Patents No. 125771 and No. 145563, both of which disclose examples of adjustable frames for installation in beds. To some extent these previously known constructions have a relatively complicated design. They offer the possibility of different angular adjustments for both the back member, seat member and foot member of the surface of a bed. In previously known designs, a change in the sitting angle will result in a relatively radical change in the angle between the seat surface and the back surface, since the surfaces are rotated about fixed axles. Due to the fact that the foot member is connected to the seat member and is slidingly guided in the frame of the bed, it will be raised above the surface of the bed in the knee area, which is not always desirable. Alternatively, special joint constructions or additional surface elements leave been employed.

Such an alternative is, for instance, described in U.S. Pat. No. 4,403,357. The reclining furniture of this patent includes a back member, a seat member and a foot member, and in addition, a flexible intermediate member between the seat member and the back member. The pivot axles of the seat and foot members are slidingly guided in rails. The pivot axles with guide rails of the foot and seat members are positioned near each other on each side of the connecting joint. The foot member has an additional axle with guide rail in order to keep the end of the foot member within the level of the frame. When the back member is lifted, the foot member will be lifted at the end near the seat member due to an inclination of the guide rail. The seat member will follow this movement. However, the inclination of the seat member will be dependent of the action of the intermediate member, which in reality will control the position of this main part of the furniture. This will make the seat position flexible and dependent of the influence of the user and the direction of movement of the back member. In addition the knee area of the furniture will be lifted, which as mentioned above, is not always desirable.

SUMMARY OF THE INVENTION

The object of the present invention is to provide an adjustment device which permits the desired changes in angular adjustment between the seat and the back member, or between the back member, the seat member and the foot member of the frame of an article of furniture. The adjustment device is simple in design and relatively inexpensive to manufacture, while at the same time, it is able to attain the angular adjustment either manually or by simple operating means, and preferably with only one single exercise of force.

This object is achieved by the adjustable article of furniture of the invention. In particular, the invention may be embodied in a three-part bed, mattress, sofa, divan or bench frame, or a two-part chair frame where the individual parts are hinged to one another and mounted in a supporting frame. The back member is pivotally mounted in a fixed horizontal transversal axis or by axles located a short distance above the hinge or joint which connects the back member to the seat member. The seat member is pivotally mounted in a fixed horizontal transverse axles and mounted in a mounting or guide which permits movement of the transverse axles slidably in an approximately straight line approximately parallel to the back's suspension axis. The foot/leg member is pivotally mounted in a preferably movable horizontal transverse axles or by means of axis journals mounted on a mounting which allows siding movement of the transverse axis in an approximately straight or approximately line and in parallel relation to the back and seat suspension axes. In the case of chairs, there are no foot/leg members. If desired, the chair can be extended with a separate stool or the like.

According to a feature of the invention, the lower part of the back, which extends from the mounting axis to the articulation with the seat member can be equipped with a lever which can be influenced by a force, possibly from an actuator or gas spring. In order to achieve further angular adjustments according to the floor area, according to a further feature of the invention the bed frame can be combined with a tilting device which can tilt the support frame about a desired smaller angle, e.g. +/−12°.

As a result of the invention it may be said that adjustable sitting furniture is supplied with the advantages which adjustable beds have, and that adjustable beds are provided with the same advantages which exist in adjustable sitting furniture. The adjustment device according to the invention offers the possibility of adjusting back members of furniture in an angular range from 0 to 75°, the seat member between 0 and 15° and the leg/foot member from 0 to 22°. In addition, as mentioned above, a tilting effect can be exercised of the order of +/−12°. The possibility is thereby obtained of adjusting angles between the back and the seat member from 180°, which means that the back and seat members are located on the same plane, to an angular adjustment of 90° between the parts. The seat member and the leg member can be angularly adjusted between 180° and about 217°. The previously known adjustable beds are normally also hinged or articulated between the individual parts or sections and are usually constructed with heavy, complicated and expensive fittings which by means of manual operation, gas springs or actuators will lift the various parts into the desired angles. With the adjustment device according to the invention a simpler, lighter and more reasonably priced adjustment concept is provided, in which only one external force may be employed to perform the required adjustments.

BRIEF DESCRIPTION OF THE DRAWINGS

The invention will now be described in more detail by means of the embodiment which is illustrated in the drawings, in which.

DESCRIPTION OF THE PREFERRED EMBODIMENTS

Figure 1A:
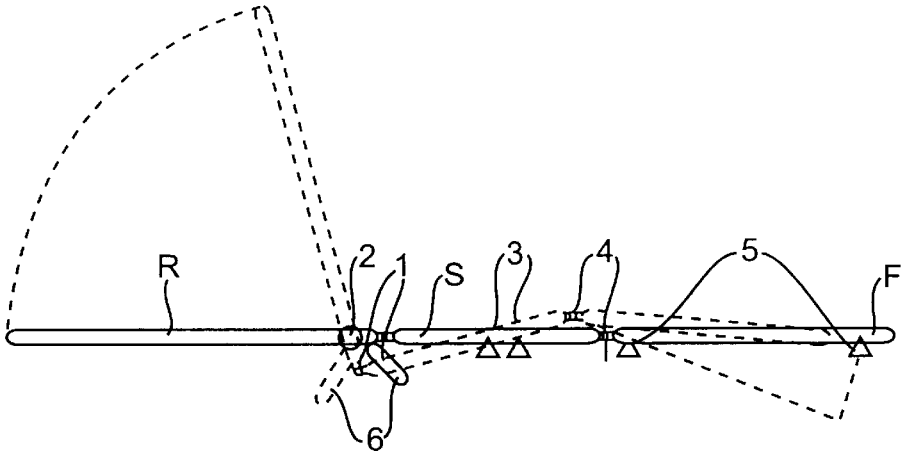
FIG. 1*a* is a schematic drawing illustrating a bed design with the adjustment device according to the invention.
Figure 8A:
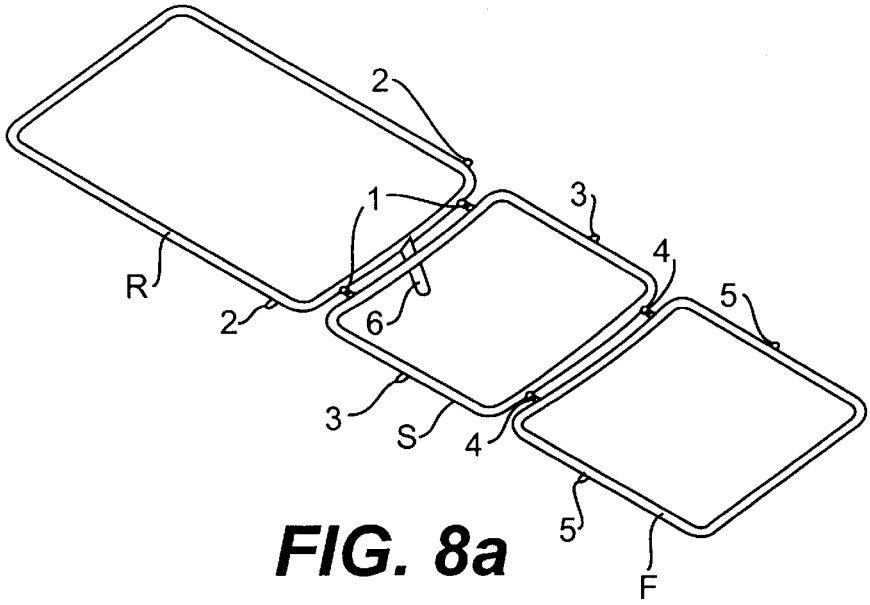
FIGS. 8*a* and 8*b* are perspective views illustrating respectively, the furniture frame and the support member for mounting in a bed frame.
Figure 9A:
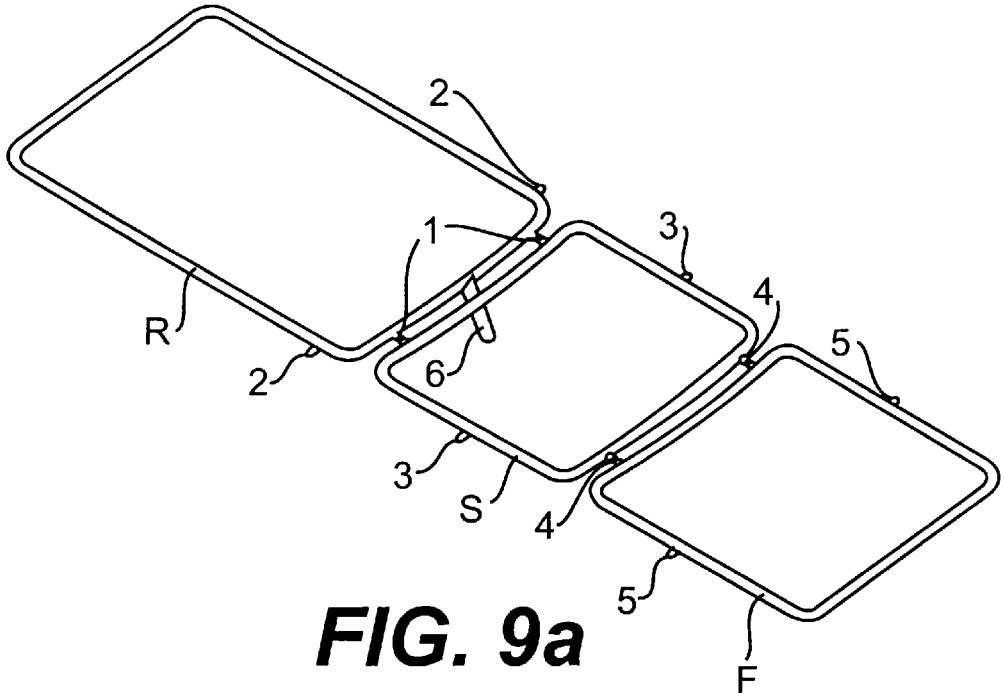
FIGS. 9*a* and 9*b* are similar perspective views illustrating a second design, where the support member of FIG. 9*b* is designed as a chassis.

The adjustment device according to the invention will now be explained in more detail in connection with the schematic illustration presented in FIG. 1*a* of the drawing. The drawing illustrates in a side view the invention in connection with a bed design, where the furniture frame or the bed frame consists of three sections or parts, R which is the back member, S which is the seat member and F which is the foot or leg member of the bed frame. Each of these three parts is equipped with transverse axles, as illustrated in FIGS. 8*a* and 9*a*. The transverse axles for the back member R are designated by 2, the transverse axles for the seat member are designated by 3 and the transverse axles for the leg member F are designated by 5. The parts of the frame are hinged or linked to one another by means of hinged joints which again are best illustrated in FIGS. 8*a* and 9*a*, in which they are designated by 1 and 4 respectively.

Figure 8B:
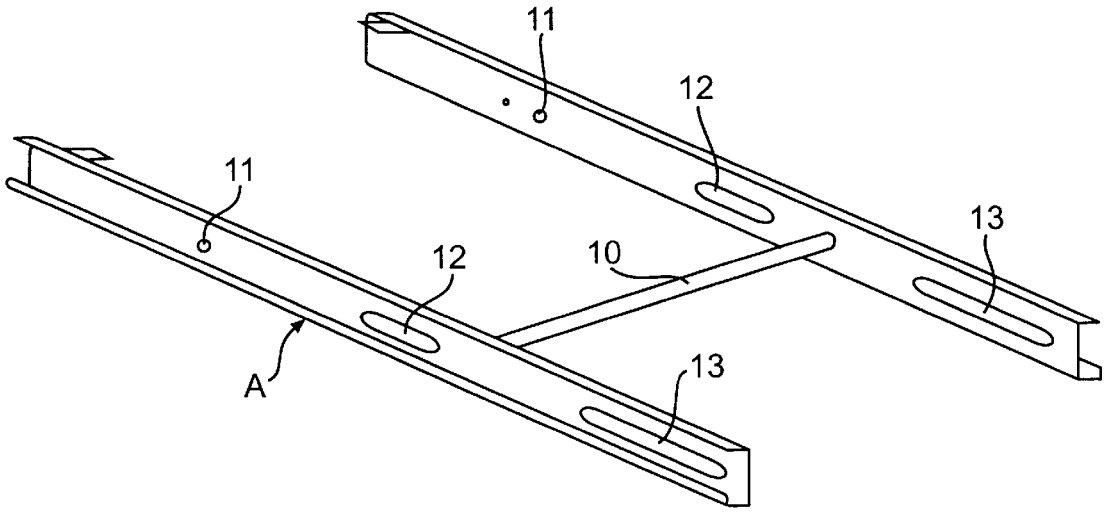
Figure 9B:
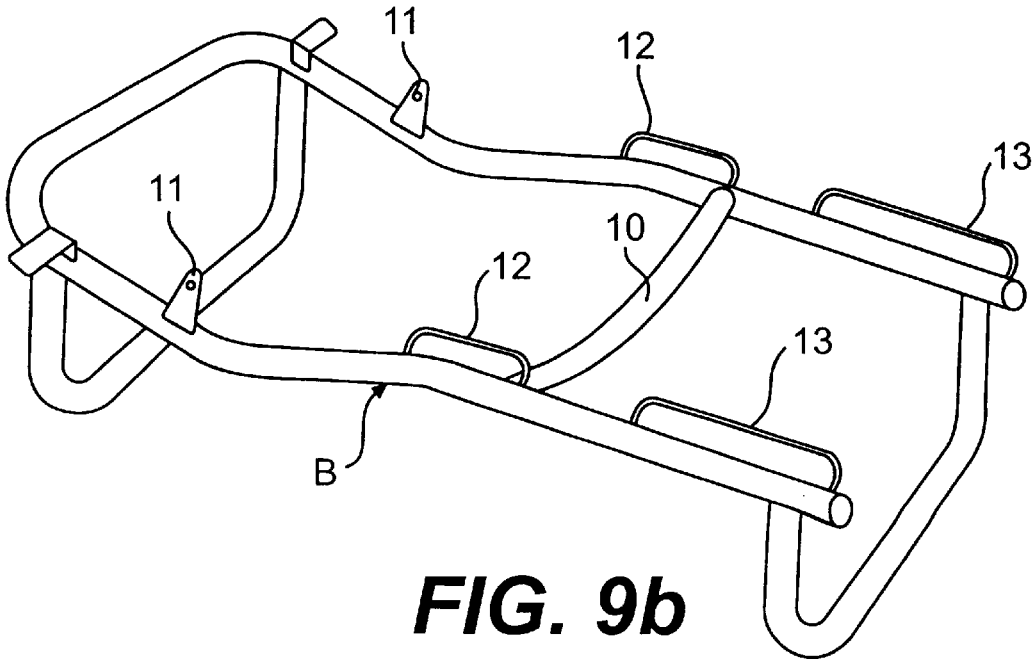

During angular adjustment of the parts R, S and F in relation to one another, the parts will rotate about the linkage points 1 and 4, while the transverse axle connection to the support member remains located in the same plane. In FIGS. 8*b* and 9*b* the support member is designated by A and B respectively, and the attachment or displacement areas for the transverse axles are designated by 11, 12 and 13. It can be seen from FIGS. 8*b* and 9*b* that the transverse axles 3 and 5 are received for sliding displacement in the slot-shaped openings, while the transverse axle 2 of the back member R has a fixed mounting.

The distance between fulcrum axes for the individual parts and the articulation between the parts determines the relative pattern of movement between the parts. The relationship of these distances, i.e. the distances between fulcrum and linkage point for back member R and the seat member S are selected in such a manner that an infinitely variable adjustment of the angle between seat member and back member can be achieved throughout an angular range of about 90° to 180°.

Figure 2:
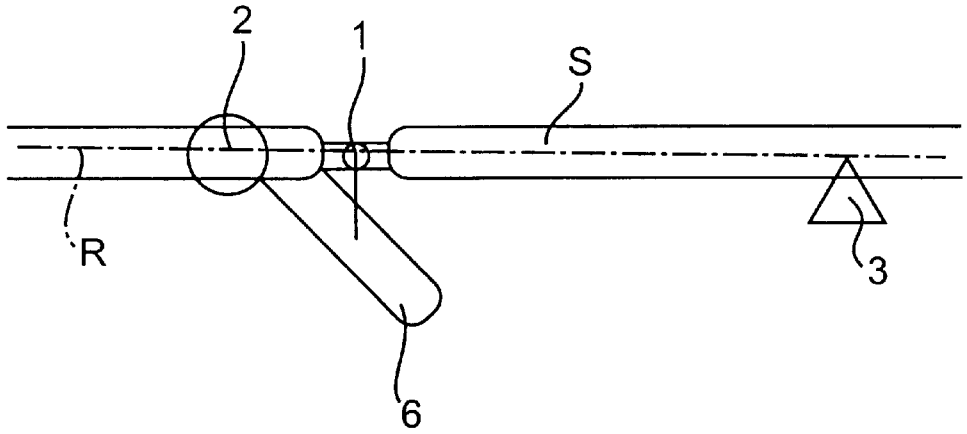
FIGS. 2 and 3 show a detail of the drawing in FIG. 1 illustrating the operating mechanism during angular adjustment between the back and seat members.
Figure 3:
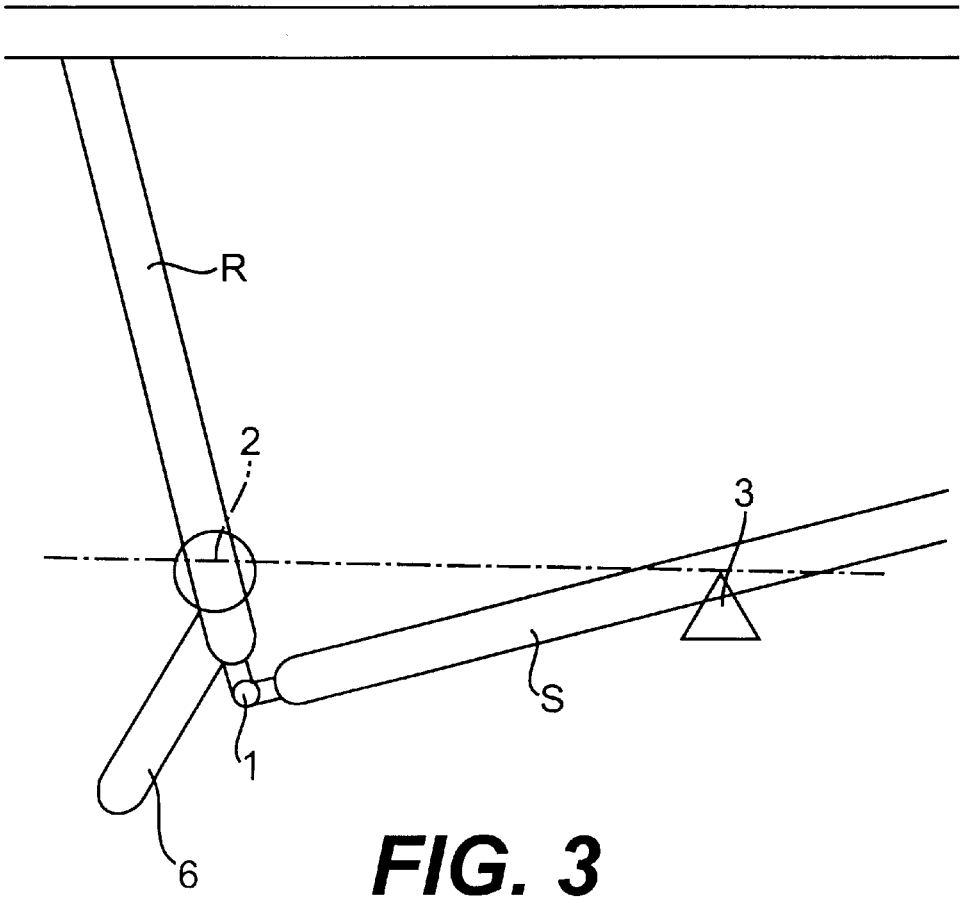
Figure 4:
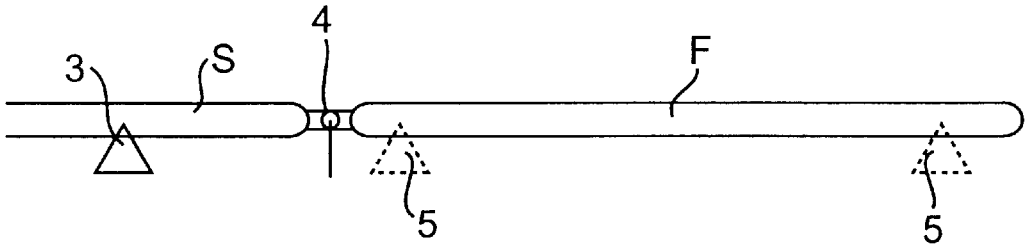
FIGS. 4–6 are views illustrating the principles of the design during angular adjustment between the seat member and the foot member.
Figure 5:
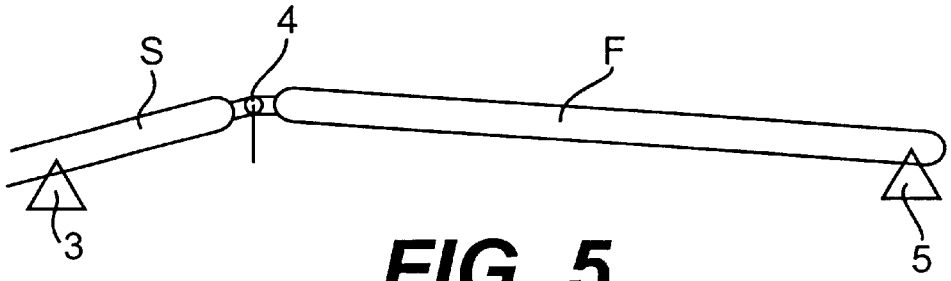
Figure 6:
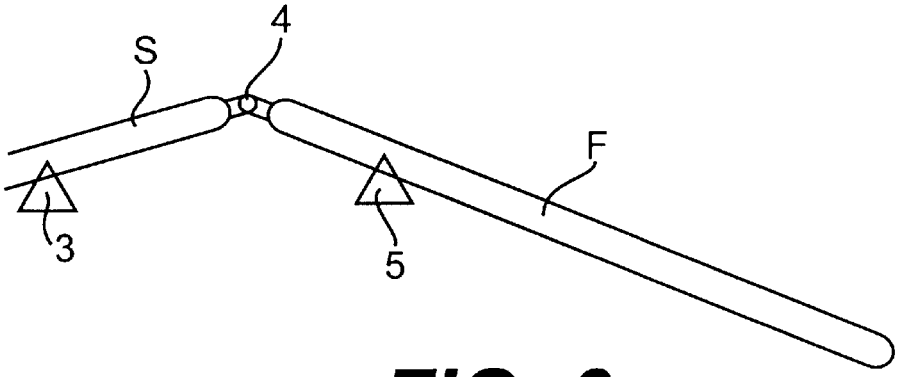

These two extreme positions are illustrated in FIG. 1, the position illustrated by a broken line showing an angular adjustment of 90° between the parts R and S. By means of this movement from the position which is illustrated by solid lines to the position illustrated by broken lines the mounting point 2 for the back member will remain fixed, while the mounting point for the seat member will be moved towards the back member, while at all times remaining located in the plane of the bed frame. This adjustment is illustrated in more detail in FIGS. 2 and 3. Here it can be seen that the mounting points 2 and 3 remain located on the same plane.

By means of this displacement of the back member to an upright position the seat member S via the joint 4 will also influence the leg member F, which will be pulled along by the movement of the seat member. The joint 4 will will thereby be pulled in the direction towards the back member and lifted slightly above the bed plane. At the same time the mounting 5 will move in the groove 13, also in the direction towards the back member, thereby controlling the angular movement of the foot member. The length relationship between the slots 12 and 13 is preferably selected so that the foot member or the leg member will fall about an angle between 4 and 22°, depending on where on the leg or foot member the suspension point 5 is located. In FIG. 1*a* and 4–6 this movement is indicated very prominently for illustrative reasons, but it may, of course, also be different to that which is shown in the figure. The movement mechanism for the foot member is illustrated on a larger scale in FIGS. 4–6.

In order to perform the angular adjustment of the back member in the simplest possible way, on the underside of the back member R there is rigidly fastened an arm piece or a lever 6, which is also illustrated in FIGS. 8 and 9. Between this lever and a point on the support member or another attachment point there may be provided a pneumatic cylinder or an electrical actuator which via the lever 6 provides for the angular adjustment and the locking of the back member R and thereby normally of all parts of the construction.

Figure 7A:
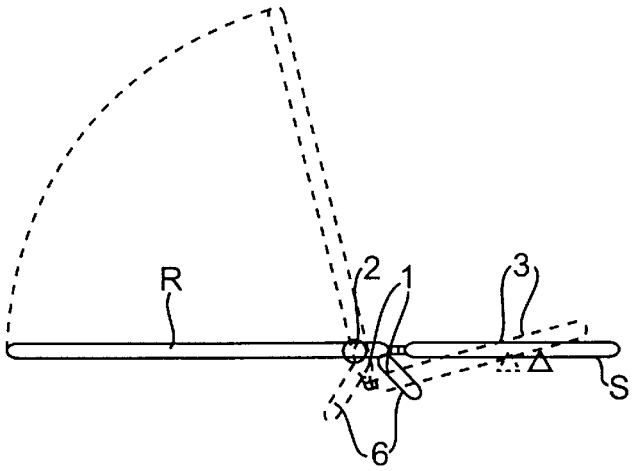
FIGS. 7*a* and 7*b* are drawings corresponding to FIG. 1 illustrating the adjustment device according to the invention for a chair design.
Figure 7B:
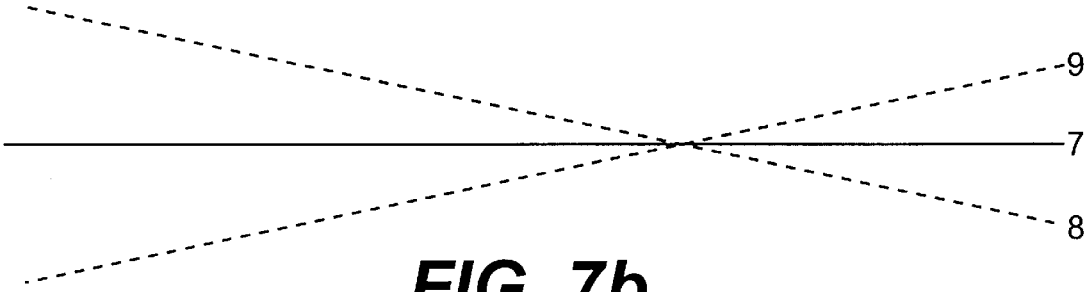

FIGS. 7*a* and 7*b* illustrate the adjustment device for the invention employed in a chair. The design differs only from that illustrated in FIG. 1*a* in that the leg member F has been removed.

FIGS. 8*b* and 9*b* illustrate the use of two different support members, FIG. 8*b* showing a support member A which is intended for mounting in a bed frame or the like, while FIG. 9*b* illustrates a design where the support member B is equipped with legs, i.e. designed as a chassis. In the design in FIG. 8*b* it will be appreciated that the support member A with the parts R, S and F may be tilted. In a design with legs, as illustrated in FIG. 9, it will also be possible to establish a tilting function. The tilting function will be particularly relevant, e.g. in connection with hospital or nursing home beds.

Figure 1B:
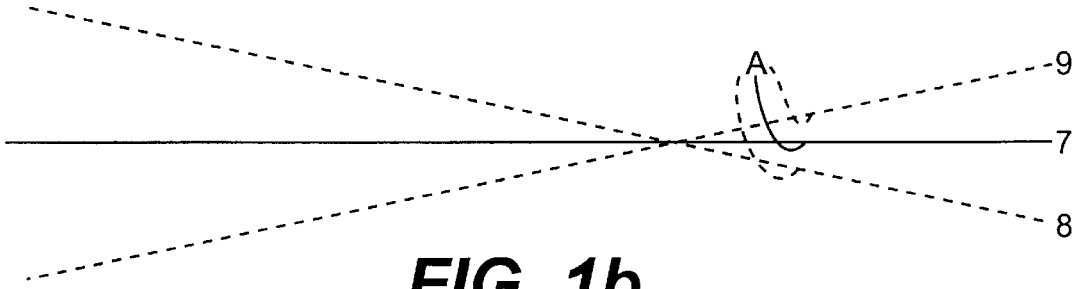
FIG. 1*b* is a schematic representation of angles of tilting to which the bed of FIG. 1*a* may be adjusted.

FIG. 1*b* also illustrates in a purely schematic form the aforementioned tilting movement for the support member, where the whole bed can be tilted, e.g., between the positions 8 and 9 in relation to the normal position 7, the settings 8 and 9 corresponding to angular adjustments of −/+12°. It should be pointed out that the angular range may be both smaller and greater, and also different in the two directions, e.g., only −12°.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An adjustable article of furniture having a length and comprising:

a supporting member;

a hinged frame including a back member having a bottom end and a seat member having a central area between front and rear ends, the bottom end of the back member being connected directly to the rear end of the seat member by a hinge having a hinge axis, means for mounting said hinged frame in the supporting member including a first pair of horizontally aligned transverse axles positioned on the back member at a first distance from the hinge axis and pivotally received in a fixed journal on the supporting member, and a second pair of horizontally aligned axles in the central area of the seat member and received in seat member slots in the supporting member, the seat member slots extending for a second distance along the length of the article of furniture, and means for controlling angular displacement of the back member and including a downwardly directed lever arm securely connected with the back member.

2. The adjustable article of furniture recited in claim 1, wherein the first and second distances are related to accommodate an angular adjustment in a range of from about 90° to 180° between the back member and the seat member.

3. The adjustable article of furniture recited in claim 1, wherein the hinged frame further includes a foot member having a central area and a rear end connected directly to the front end of the seat member by a second hinge having a second hinge axis.

4. The adjustable article of furniture recited in claim 3, including a third pair of horizontally aligned axles in the central area of the foot member and received in foot member slots in the supporting member, the foot member slots extending for a third distance along the length of the article of furniture.

5. The adjustable article of furniture recited in claim 4, wherein the third distance is longer than the second distance.

6. The adjustable article of furniture recited in claim 5, wherein the first and second distances are related to accommodate an angular adjustment in a first range of from about 90° to 180° between the back member and the seat member, and the second and third distances are related to cause an angular change between the foot member and the seat member in a second range of from about 217° to 180° for angular adjustment between the back member and the seat member throughout the first range.

7. The adjustable article of furniture recited in claim 1, wherein the supporting member is tiltable about an angle of between +12° and −12° in relation to a floor surface.

8. The adjustable article of furniture recited in claim 1, wherein the means for controlling angular displacement of the back member includes a gas spring connected to the downwardly directed lever arm.

* * * * *